US007540460B2

(12) United States Patent
Orth et al.

(10) Patent No.: US 7,540,460 B2
(45) Date of Patent: Jun. 2, 2009

(54) MOUNTING ASSEMBLY

(75) Inventors: Scott Donald Orth, Owings Mills, MD (US); Steven Saint John Tourison, Glen Burnie, MD (US); David Allen Fitzpatrick, Forest Hill, MD (US)

(73) Assignee: Britannia Investment Corporation, San Diego, CA (US)

( * ) Notice: Subject to any disclaimer, the term of this patent is extended or adjusted under 35 U.S.C. 154(b) by 320 days.

(21) Appl. No.: 11/454,961

(22) Filed: Jun. 16, 2006

(65) Prior Publication Data

US 2007/0290112 A1 Dec. 20, 2007

(51) Int. Cl.
*B42F 13/00* (2006.01)

(52) U.S. Cl. ..... 248/343; 381/386

(58) Field of Classification Search ..... 248/343, 248/317, 323, 342, 231.9, 205.1; 381/87, 381/386, 150, 182, 385, 395
See application file for complete search history.

(56) References Cited

U.S. PATENT DOCUMENTS

| | | | | |
|---|---|---|---|---|
| 1,752,472 | A | 4/1930 | Whitney | |
| 2,670,919 | A | 3/1954 | Esoldi | |
| 2,788,188 | A | 4/1957 | Smith et al. | |
| 3,518,421 | A | 6/1970 | Cogdill | |
| 4,463,923 | A | 8/1984 | Reiker | |
| 4,513,994 | A | 4/1985 | Dover et al. | |
| 4,909,405 | A | 3/1990 | Kerr, Jr. | |
| 5,044,582 | A | 9/1991 | Walters | |
| 5,400,412 | A | 3/1995 | King et al. | |
| 5,574,796 | A * | 11/1996 | Keezer | 381/386 |
| 5,690,423 | A * | 11/1997 | Hentz et al. | 362/365 |
| 5,957,574 | A * | 9/1999 | Hentz et al. | 362/365 |
| 6,578,808 | B1 | 6/2003 | Bertagni et al. | |
| 6,870,943 | B2 * | 3/2005 | Liu | 381/395 |
| 7,234,674 | B2 * | 6/2007 | Rippel et al. | 248/343 |
| 2003/0006353 | A1 * | 1/2003 | Dinh et al. | 248/343 |
| 2003/0155473 | A1 * | 8/2003 | Rivera et al. | 248/205.1 |
| 2004/0005073 | A1 * | 1/2004 | Liu | 381/395 |
| 2005/0067546 | A1 * | 3/2005 | Dinh | 248/343 |
| 2005/0230589 | A1 * | 10/2005 | Wronski | 248/323 |

* cited by examiner

*Primary Examiner*—Ramon O Ramirez
(74) *Attorney, Agent, or Firm*—Medler Ferro PLLC

(57) ABSTRACT

A mounting assembly for mounting a fixture such as a loudspeaker speaker in-wall or in-ceiling includes a bracket assembly to mechanically couple wall or ceiling and speaker to the supporting studs or joists on both sides of the hole in which the loudspeaker will be mounted. The bracket assembly may comprise two halves, each of which includes a bracket plate, a left bracket slider and a right bracket slider, and associated fasteners. Each half of the bracket is sized so that it will pass easily through the opening made in the partition for receiving the loudspeaker. Once inside the partition, the two bracket sliders expand to reach the nearby studs or joists where they are coupled to the studs or joists using fasteners such as screws. Once the bracket sliders are attached, they are secured to the bracket plate with fasteners such as thumbscrews, thereby making a rigid structure. This is repeated for the other half of the bracket assembly. The loudspeaker is then inserted into the hole and secured using the clamping dog fixtures integral to the loudspeaker. These clamps sandwich the loudspeaker frame, partition and bracket assembly into one rigid structure.

20 Claims, 9 Drawing Sheets

MOUNTING ASSEMBLY

BACKGROUND OF THE INVENTION

1. Field of the Invention

The present invention relates to assemblies for mounting devices for reproducing sound, such as loudspeakers, in a barrier or partition. More specifically, it relates to more convenient means for mounting loudspeakers in the walls or ceiling of a room in such a way that performance is also improved.

2. Background of the Invention

Loudspeakers built into walls or ceilings as a substitute for conventional floor standing or book shelf loudspeakers have grown in popularity over the last few decades. Their appeal lies in their low visual impact in a room and that they occupy negligible space in the occupied area.

Many different mounting systems for so called "in-wall" or "in-ceiling" loudspeakers are currently in use, such as is disclosed in U.S. Pat. Nos. 6,578,808 and in 5,400,412. However, the primary focus of these systems is convenience and ease of installation for the installer. Most of these systems rely on the face material of the partition, usually drywall, to support the speaker system and utilize some form of clamping system to hold the speaker system in place. However, research has shown that drywall does not have adequate stiffness or damping to deliver audio performance equal to that typically delivered by freestanding loudspeakers whose enclosures are constructed from materials better suited to suppressing the vibrations produced by a loudspeaker. Due in part to this problem, it is generally accepted that in-wall speakers do not perform as well as free standing speakers of otherwise equivalent cost and quality.

The negative effect of this lack of proper vibration control is two fold. First, energy that would be used by the loudspeaker system to make music is now transferred to the surrounding wall or ceiling. This does not happen evenly at all frequencies and will distort the resulting sound in the room. Additionally, the energy transmitted to the wall can cause the wall or anything attached to it to vibrate and cause unwanted noises such as buzzes or rattles. This transmitted energy may also cause unwanted noises in rooms on the opposite side of the wall upon which the speaker is mounted.

One mounting method that attempts to address this problem is to provide an enclosure inside the wall for containing the acoustic energy radiated from the rear of the speaker. In this method, a pre-fabricated or custom built enclosure is mounted between the studs or joists prior to installation of drywall. The enclosure defines a mounting hole and location for the speaker and, depending on the means of securing the enclosure in the wall and the means for mounting the speaker in the enclosure, may help control vibration of the drywall. However, these enclosures are, of necessity, larger than the required mounting hole and must either be installed prior to drywall installation or will require removal, replacement and refinishing of substantial sections of the drywall in a retro-fit installation. In addition, standard enclosures may not fit in the wall space available due to pre-existing conditions such as irregular construction or the presence of other building systems already in the wall. Fabrication of a costly custom enclosure would be required in such circumstances to employ this method.

Other in-wall loudspeaker mounting devices known as "pre-construction brackets" or "rough-in kits" are often used in new construction. These brackets are often attached to two studs or ceiling joists using nails or screws prior to drywall installation for the purpose of locating the mounting hole for an in-wall loudspeaker, prior to drywall installation. These brackets provide the drywall installer with a guide to make the speaker mounting hole in the correct place as the drywall is being placed. However, since the only purpose of these brackets is to act as a location guide they are typically made from inexpensive materials, usually plastic, which offer no structural support. Once the speaker is mounted it still depends almost solely on the rigidity of the drywall surrounding the hole for support and for control of the vibration produced by the loudspeaker. Also, as their name implies, these pre-construction brackets are only usable before the drywall has been installed.

Similar pre-construction brackets are used in the lighting and electrical industry for locating and supporting lighting fixtures, electrical boxes and the like prior to drywall installation. Such a device is disclosed in U.S. Pat. No. 5,957,574. In addition, there are numerous prior art brackets for locating and supporting electrical boxes or fixtures from adjacent studs or joists as is disclosed, for example, in U.S. Pat. Nos. 1,752,472, 2,670,919, 2,788,188, 3,518,421, 4,463,923, 4,513,994 and 4,909,405, each of which is incorporated in its entirety herein by reference. As can be seen from these disclosures some of these devices are also suitable for installation after drywall is in place. However, since control of acoustically induced vibration is not an issue, none of these devices include any means for improving the rigidity or resistance to vibration of the drywall between the mounting hole and the adjacent studs or joists.

It is therefore clear that a need exists for an in-wall or in-ceiling loudspeaker mounting system which is both practical in retro fit applications, easy to install and offers performance improvements through improved structural integrity and control of acoustically induced vibration.

SUMMARY OF THE INVENTION

An improved mounting system for use in in-wall and in-ceiling loudspeaker systems is disclosed. The mounting system can be installed either before or after drywall has been affixed to the wall or ceiling without damaging the wall or ceiling in either case. The mounting system is easy to install and requires a minimal number of common tools to install.

In accordance with an embodiment of the present invention, a bracket assembly is used to mechanically couple the partition and loudspeaker to the supporting studs or joists on both sides of the hole in which a loudspeaker will be mounted. The bracket assembly may comprise two halves, each of which includes a bracket plate, a left bracket slider and a right bracket slider, and associated fasteners. Each half of the bracket is sized so that it will pass easily through the opening made in the partition for receiving the loudspeaker. Once inside the partition, the two bracket sliders expand to reach the nearby studs or joists where they are coupled to the studs or joists using fasteners such as screws. The bracket is installed such that the bracket plate is flush to the interior face of the partition. Once the bracket sliders are attached, they are secured to the bracket plate with fasteners such as thumbscrews, thereby making a rigid structure. This is repeated for the other half of the bracket assembly.

The loudspeaker is then inserted into the hole and secured using the clamping "dog" fixtures integral to the loudspeaker. These clamps sandwich the loudspeaker frame, partition and bracket assembly into one rigid structure which is itself anchored to the supporting members of the partition by the bracket sliders as previously discussed. The resulting stiffness and vibration control of the new structure is superior to that of the partition alone. This may improve the audio performance of the loudspeaker and reduce unwanted vibration and noise in the room.

Other aspects and features of the present invention will become apparent to those of ordinary skill in the art upon review of the following figures and detailed description.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE DRAWINGS

Specific embodiments of the present invention are now described with reference to the figures, where like reference numbers in the figures and description indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

Figure 1:
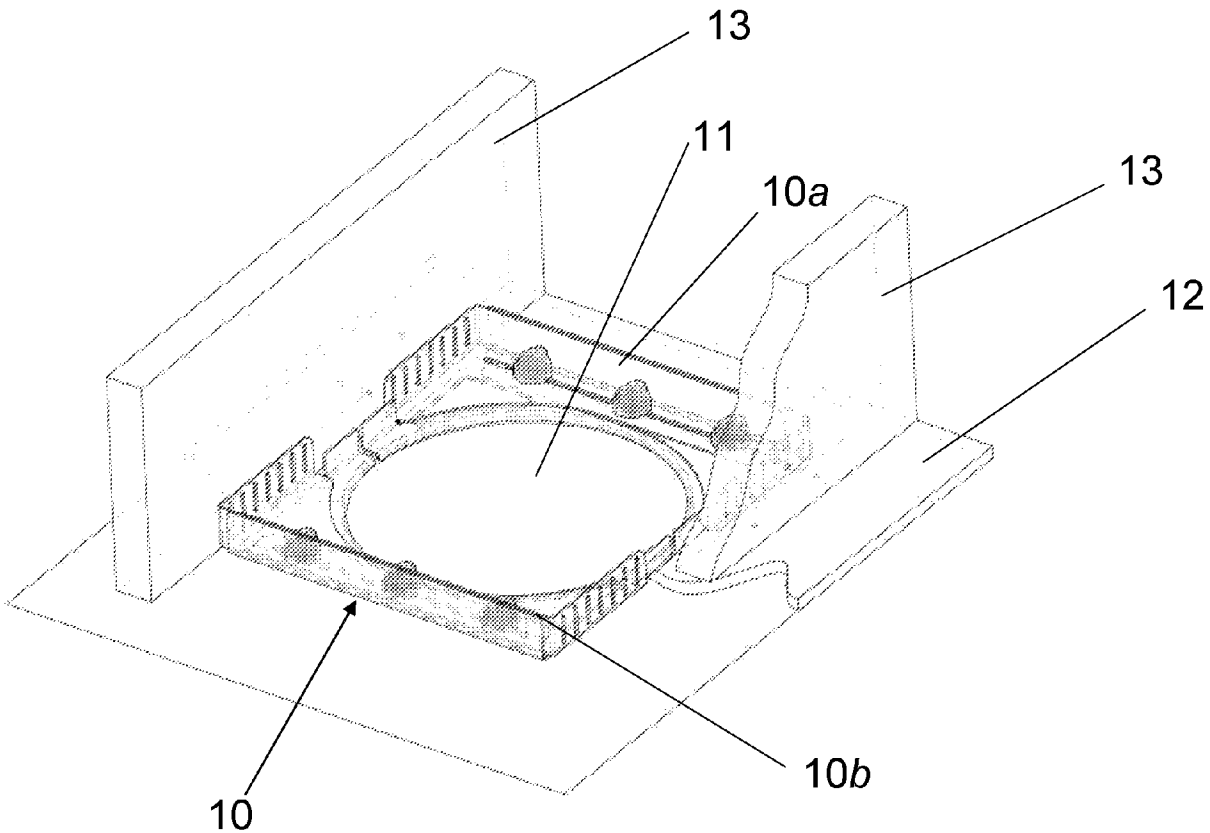
FIG. 1 is a perspective view of a bracket assembly in accordance with an embodiment of the present invention.

FIG. 1 illustrates a fully assembled bracket assembly 10 of an embodiment of the present invention installed in a partition 12. Partition 12 may be, for example, a wall or a ceiling, and is commonly made of, but not limited to, drywall. Partition 12 of FIG. 1 is a ceiling and the view is from above the ceiling of the room into which a loudspeaker will radiate sound. Partition 12 is commonly attached via a plurality of fasteners such as drywall screws (not shown) to supporting members 13, which may be studs or joists. A hole 11 is cut in partition 12 to receive a loudspeaker and bracket assembly 10. Hole 11 is no larger than that required to receive the loudspeaker. This obviates the need for repairing partition 12 following the installation of the loudspeaker, which is desirable for retrofit applications. Bracket assembly includes a first half 10*a* and a second half 10*b*.

Figure 2:
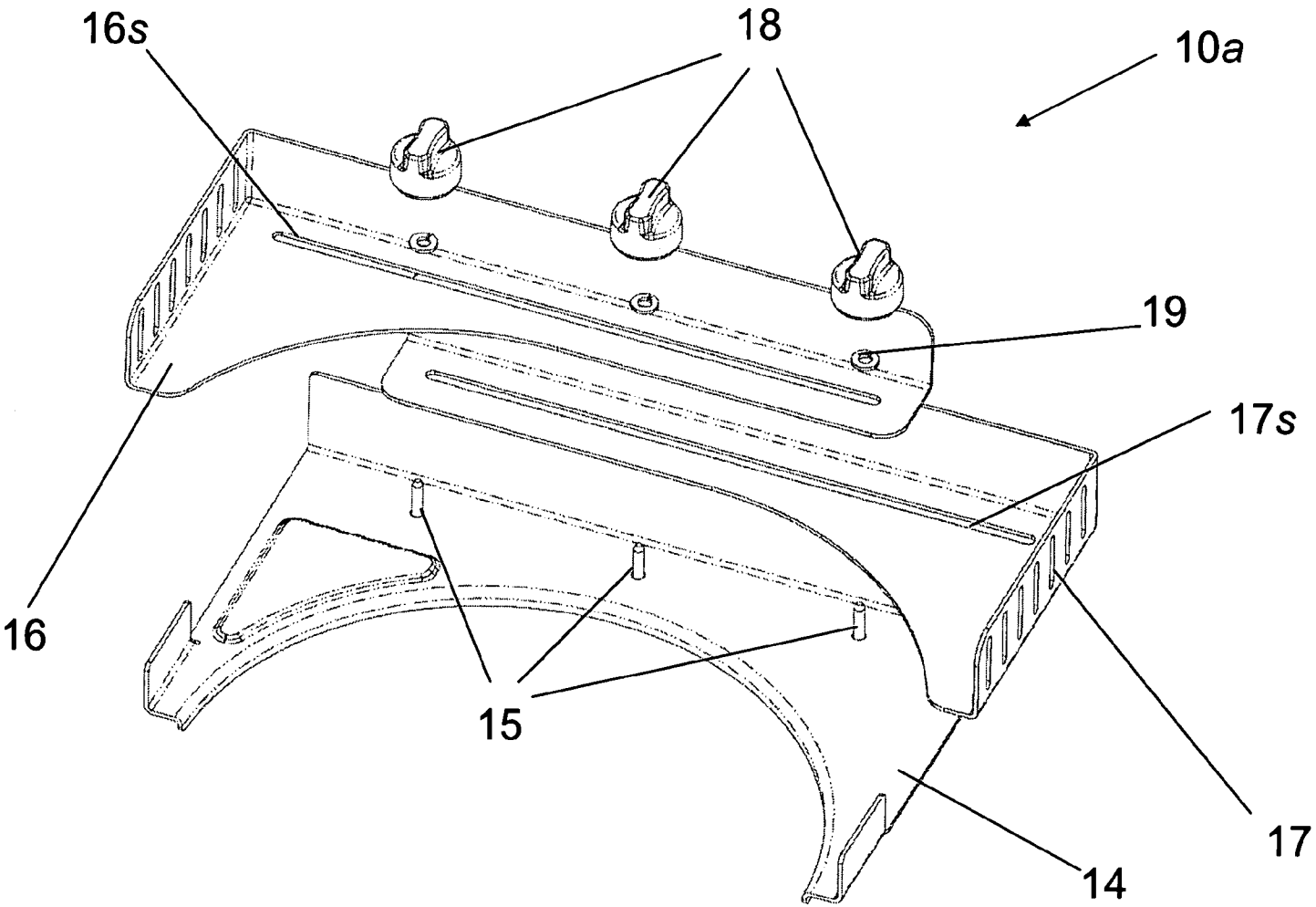
FIG. 2 is an exploded view of one half of the bracket assembly, illustrating the constituent parts thereof.

FIG. 2 is an exploded view of first half 10*a* of bracket assembly 10 of FIG. 1. First half 10*a* of the bracket assembly includes a bracket plate 14, left bracket slider 16 and right bracket slider 17. Bracket plate 14 is fitted with multiple threaded studs 15 which extend through slots 16*s* and 17*s* in left and right bracket sliders 16, 17, respectively, and are fastened using multiple fasteners 18. As shown in FIG. 2, fasteners 18 are thumbscrews, which are easy to use, however, fasteners 18 may be any fastener suitable for rigidly fixing left and right bracket sliders 16, 17 to bracket plate 14, for example, common nuts, wing nuts or lever clamps. Lock washers 19 may be used between fasteners 18 and left and right bracket sliders 16, 17. Bracket assembly 10 may be made of any material that is rigid enough to provide the necessary stiffness. Examples of suitable materials may be, but not limited to, aluminum, stainless steel, plastic, metals and metal alloys.

Figure 3:
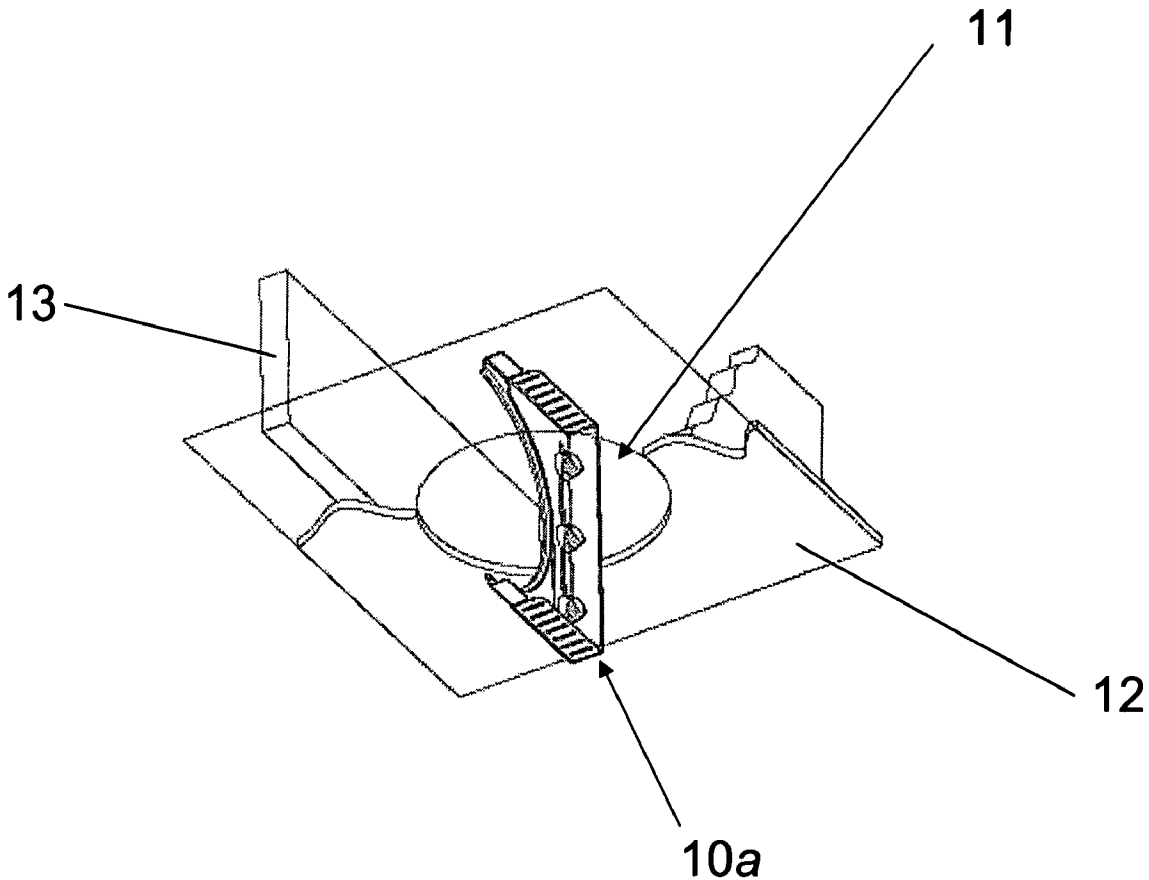
FIG. 3 is a perspective view demonstrating the passage of the bracket assembly through a hole in a partition made to receive a loudspeaker.

The installation of the bracket assembly will now be explained. FIG. 3 shows first half 10*a* of the bracket assembly being inserted through hole 11 in partition 12. After first half 10*a* is installed, second half 10*b* is installed in similar fashion. This enables the bracket assembly to be installed through partition 12 despite the final assembly of the bracket assembly being larger than hole 11 through which the bracket assembly is installed.

Figure 4B:
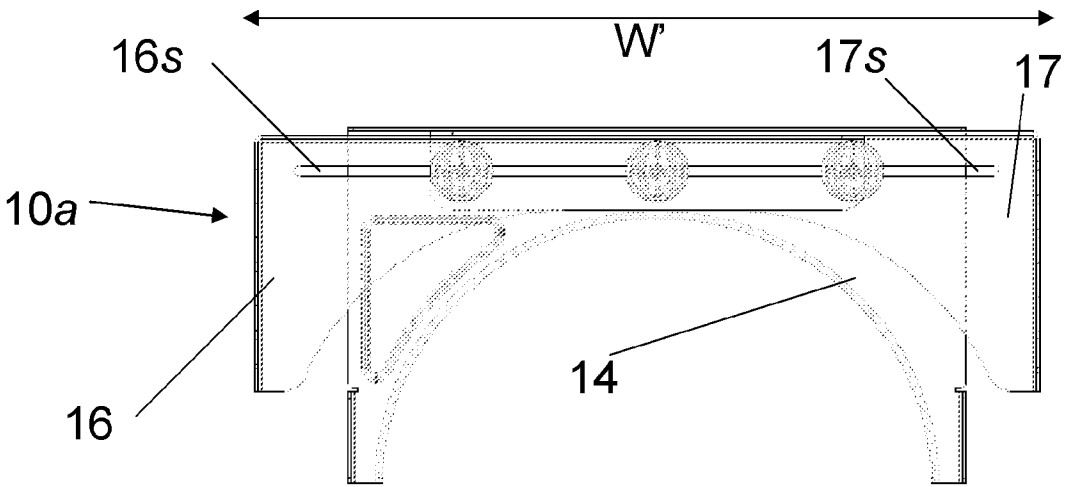
FIGS. 4A and 4B are overheads view of one bracket assembly showing the bracket sliders in their closed and expanded states, respectively.
Figure 4A:
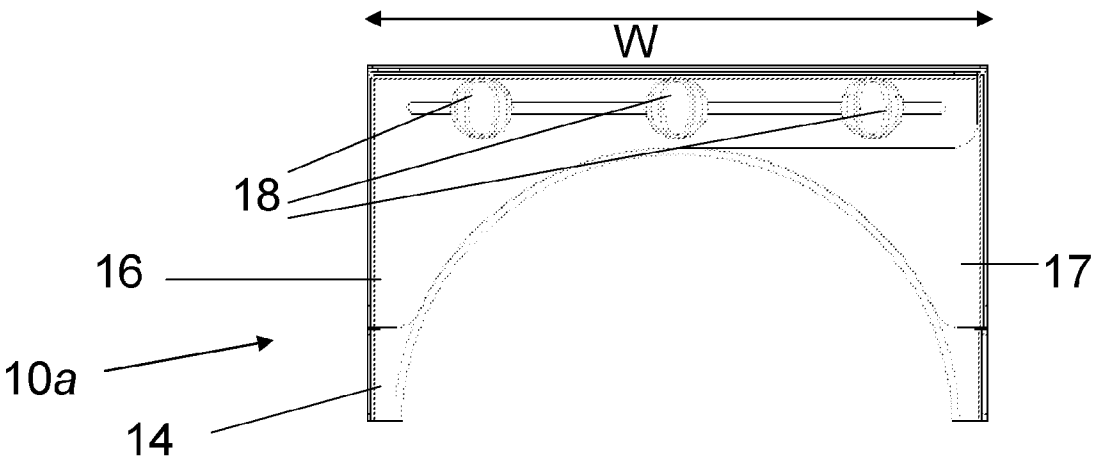

FIGS. 4A and 4B illustrate the motion of the bracket sliders 16, 17 upon the bracket plate 14. FIG. 4A illustrates a top view of first half 10*a* of the bracket assembly in its unexpanded condition, such that left bracket slider 16 and right bracket slider 17 completely overlap each other such that the overall width W of the first half of the bracket assembly is minimized. FIG. 4B illustrates how left bracket slider 16 and right bracket slider 17 can be moved apart such that the overall width W' of the first half of the bracket assembly is greater than the width of either one of the bracket sliders. Left and right bracket sliders 16, 17 move apart from each other in the direction of the arrows shown in FIG. 4A by loosening fasteners 18, and studs 15 (shown in FIG. 2) sliding along slots 16*s* and 17*s* as left and right bracket sliders 16, 17 are pulled apart. Each of left and right bracket sliders 16, 17 may be moved independently, thereby allowing different amounts of lateral extension from each bracket slider 16, 17. Referring to FIG. 1, this enables the installer to locate hole 11 in partition 12 at unequal distances from supporting members 13. It would be apparent to those skilled in the art that the motion of the sliders could be of several other embodiments such as the telescoping movement shown in U.S. Pat. Nos. 5,044,582, 4,513,994, and 4,463,923, or a ratcheting system as shown in U.S. Pat. No. 2,670,919 (FIG. 4), each of which is incorporated in its entirety by reference herein.

Figure 5:
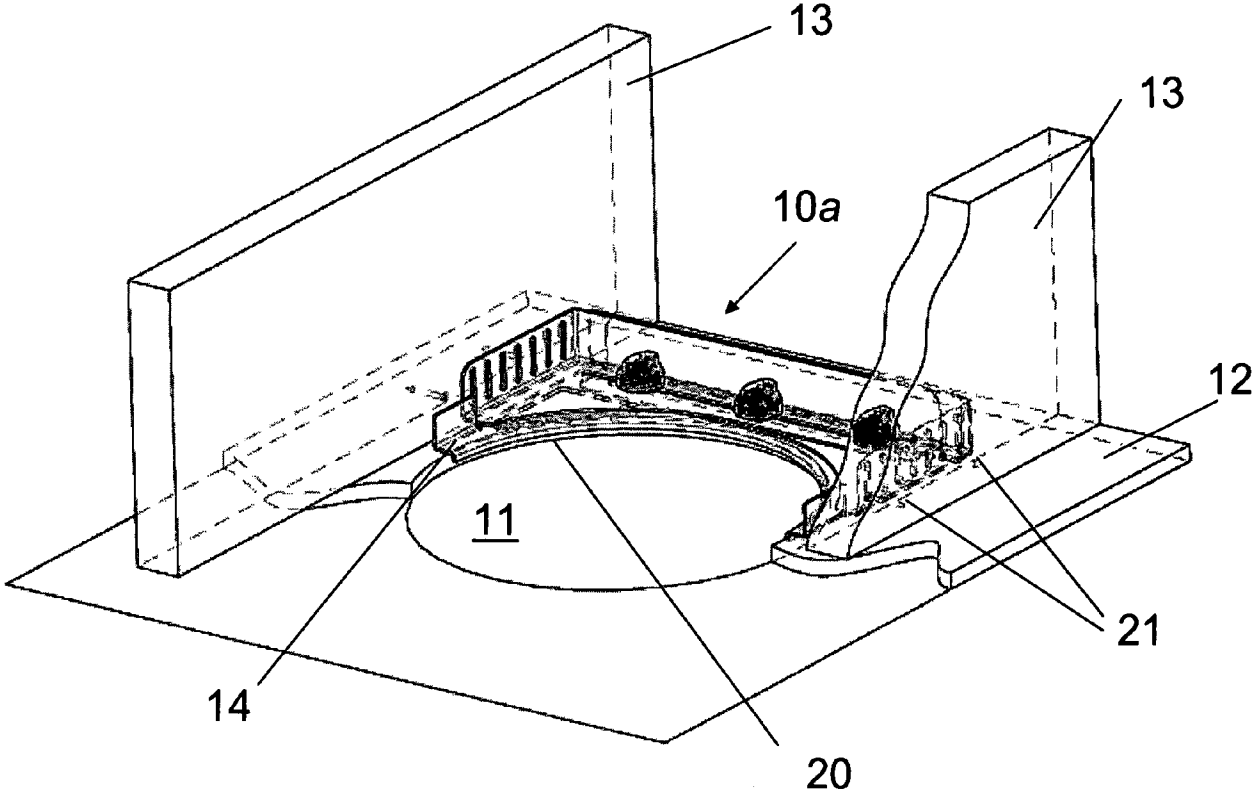
FIG. 5 is a perspective view of one half of the bracket assembly installed.

FIG. 5 illustrates first half 10*a* of the bracket assembly installed around hole 11 of partition 12. A lip 20 in bracket plate 14 helps to prevent bracket plate 14 from becoming misaligned while left and right bracket sliders 16, 17 are extended to contact supporting members 13. Left and right bracket sliders 16, 17 are attached to supporting members 13 by means of fasteners 21, such as screws or any other suitable fastener. Once fastened to supporting members 13, bracket sliders 16, 17 are then fastened to bracket plate 14 using fasteners 18 and lock washers 19, as shown in FIG. 2.

Figure 6:
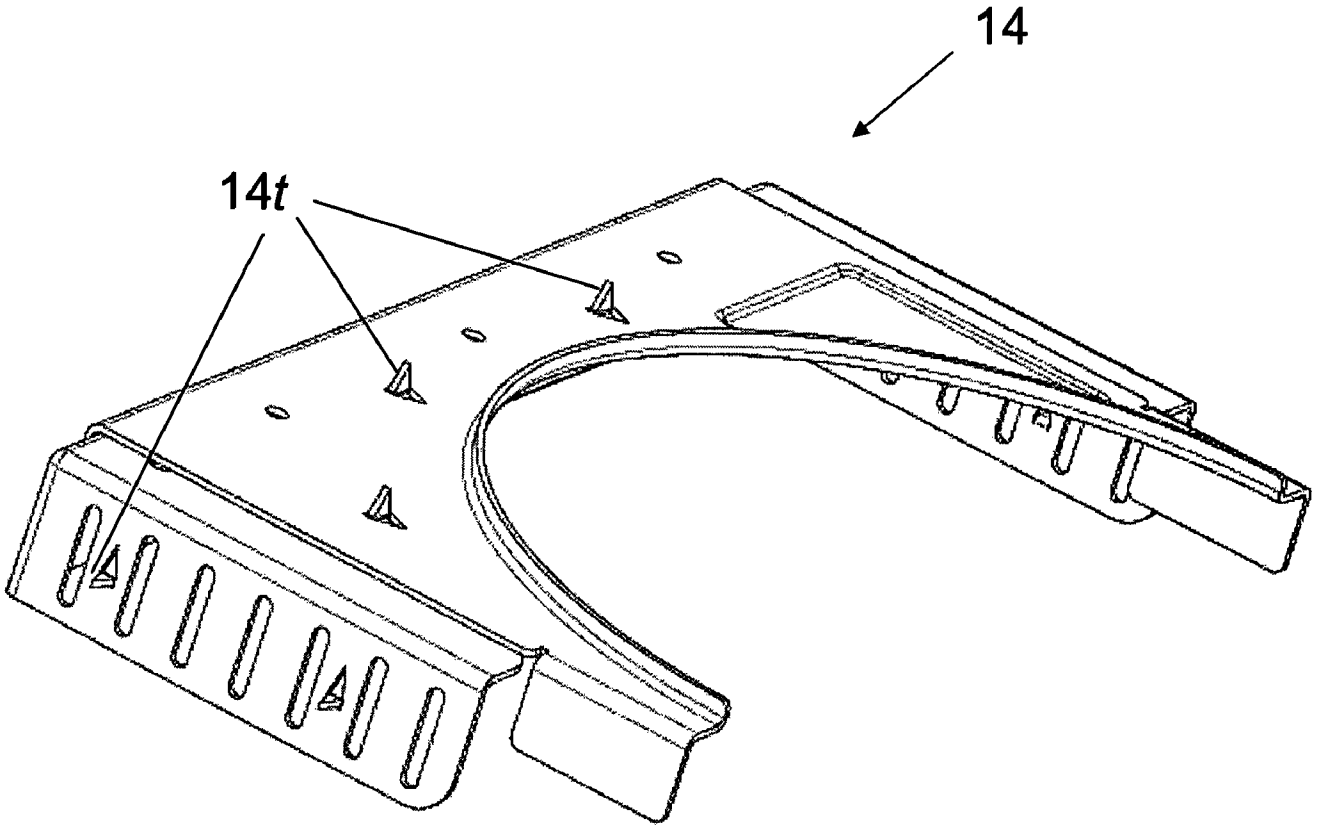
FIG. 6 is perspective view of an alternative embodiment of a bracket plate including teeth to dig into the partition when the bracket assembly is clamped down.

Bracket plate 14 may optionally include teeth 14*t* that will dig into partition 12 when bracket assembly 10 is clamped down, as shown in FIG. 6, and as described in U.S. Pat. Nos. 5,044,582, 4,909,405, and 3,518,421 (FIG. 3, detail 16), each of which is incorporated in its entirety by reference herein. Further, hole 11 in partition 12 and the corresponding shape of bracket assembly 10 need not be limited to a circle. Other polygons and conical section shapes are readily adaptable.

Second half 10*b* of bracket assembly 10 is mounted in a similar manner to first half 10*a* and the entire assembly is illustrated in FIG. 1.

Figure 7:
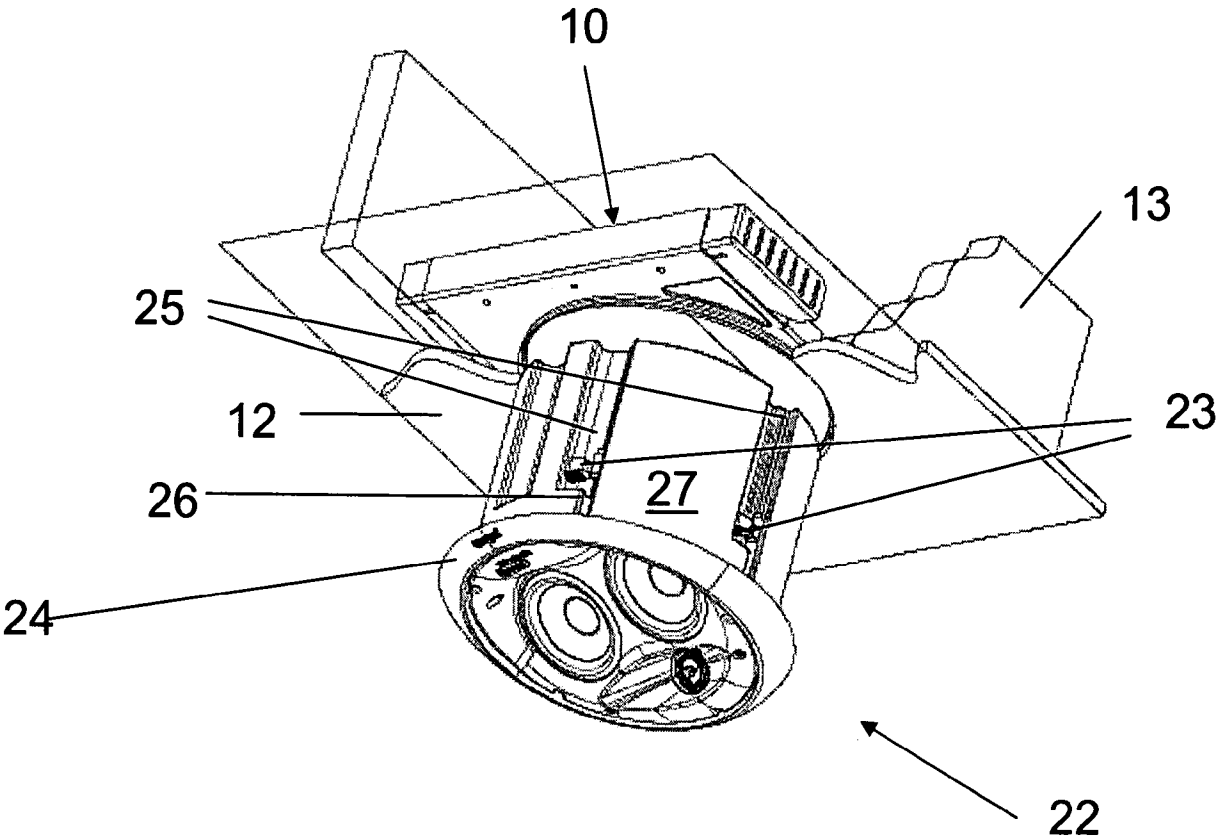
FIG. 7 is a perspective view illustrating the loudspeaker immediately prior to being inserted into the bracket assembly.

With bracket assembly 10 installed into partition 12, a loudspeaker 22 may be coupled to bracket assembly 10, as shown in FIG. 7. FIG. 7 shows a perspective view of loudspeaker 22 immediately prior to being installed into partition 12. Loudspeaker 22 includes mounting dogs 23 disposed about the periphery thereof and a lip 24. FIG. 7 shows that mounting dogs 23 are disposed in grooves 25 formed in the outer surface 27 of loudspeaker 22.

Figure 8:
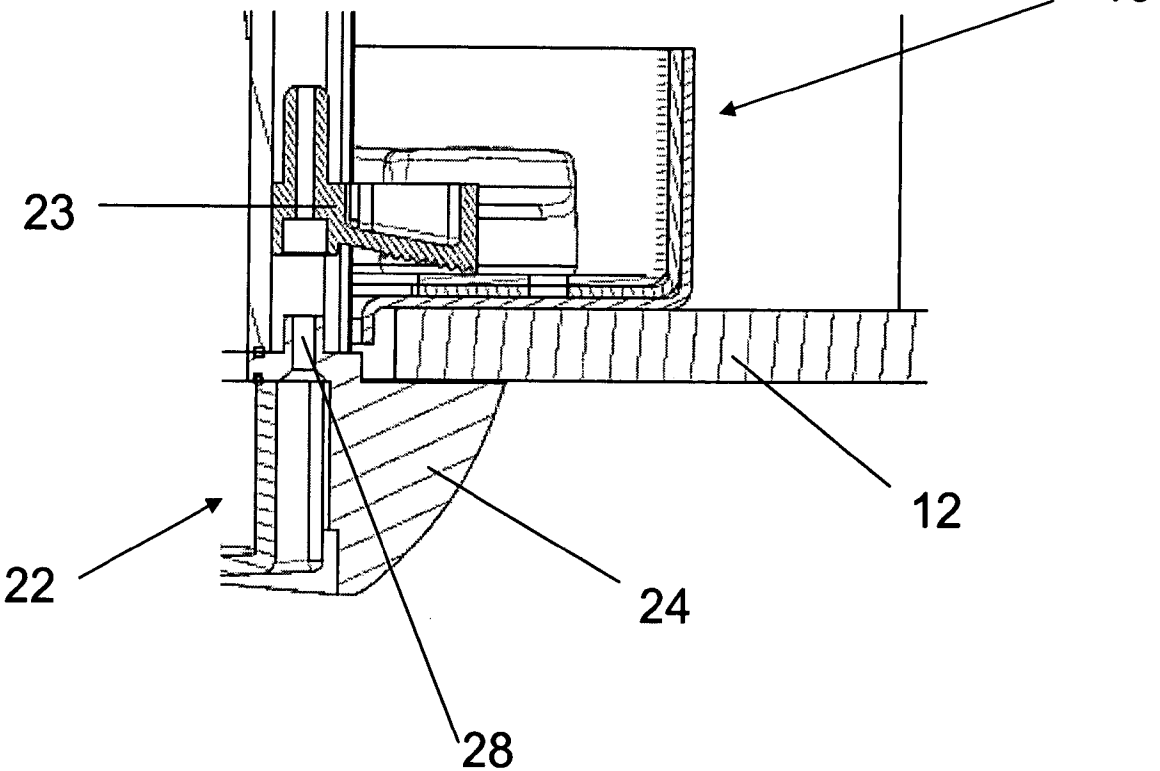
FIG. 8 is a partial sectional view illustrating the assembled system, including the bracket assembly, partition, and loudspeaker.
Figure 9:
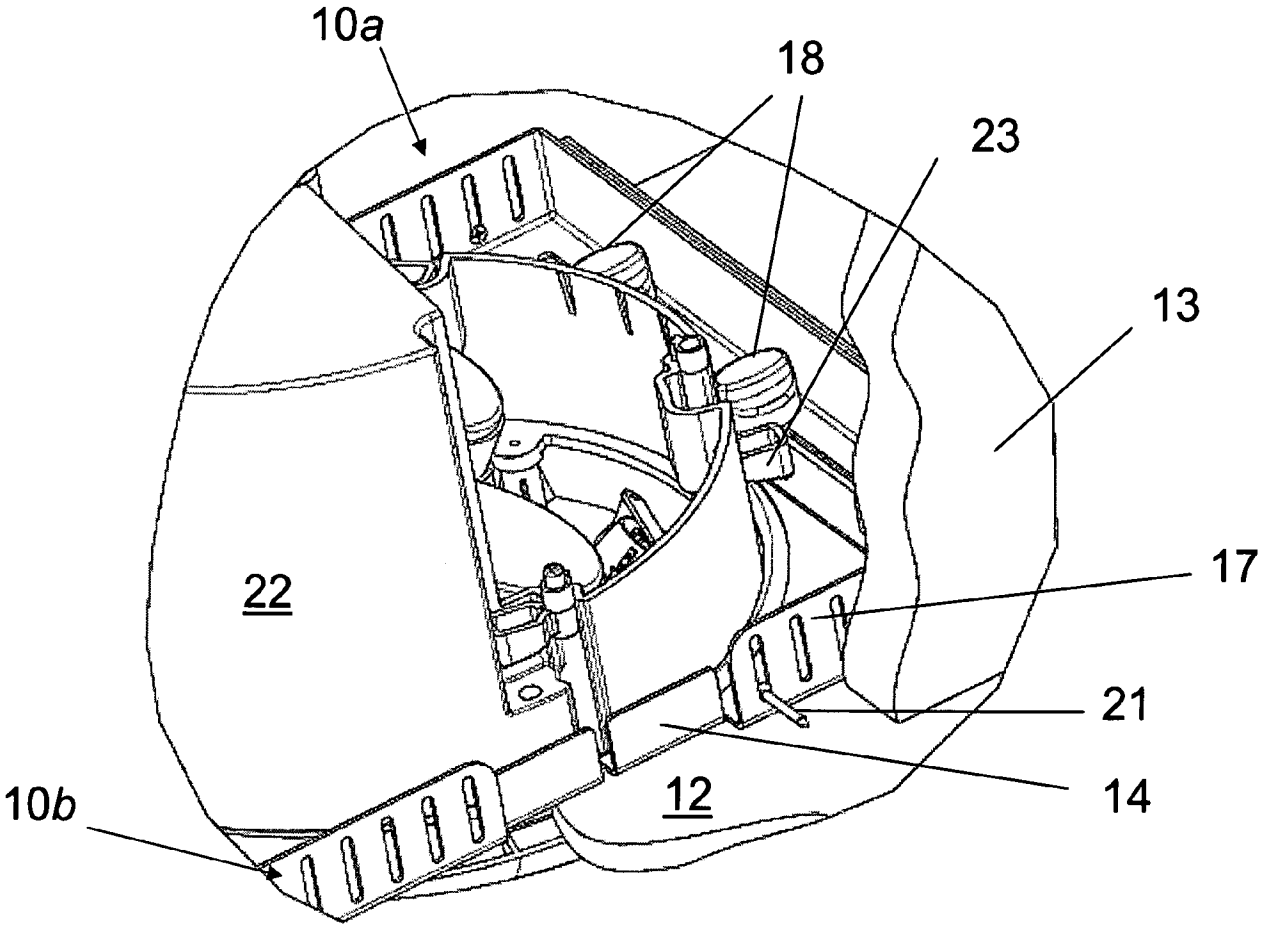
FIG. 9 is a partial cut-away view showing the assembled system, including the bracket assembly, loudspeaker, partition, and supporting member.

In order to secure loudspeaker 22 in partition 12, mounting dogs 23 are tightened to claims partition 12 and bracket assembly 10 are between mounting dogs 23 and lip 24, as shown in FIGS. 7-9. As shown in FIG. 8, a screw 28 can be accessed from the front of loudspeaker 22 for each mounting dog 23. Mounting dogs 23 are initially flat within grooves 25 (shown in FIG. 7). When loudspeaker 22 is inserted into hole 11, screw 28 is turned to extend mounting dog 23 into the extended position in which mounting dog 23 is substantially perpendicular to outer surface 27 of loudspeaker 22. By continuing to turn screw 28, mounting dog 23 moves toward lip 24 into groove 26 (shown in FIG. 7), until mounting dog 23 clamps bracket assembly 10 and partition 12 between mounting dog 23 and lip 24. This process is repeated for each mounting dog 23. Although mounting dogs 23 and screws 28 are shown, it would be apparent to one skilled in the art that any type of clamping mechanism used for mounting loudspeakers may be used.

FIG. 9 is a cutaway view illustrating loudspeaker 22 and bracket assembly 10 fully assembled in place. Once fastened to supporting members 13 and clamped together, the loudspeaker 22, bracket assembly 10, partition 12 and supporting members 13 form a rigid structure which has vibration control and damping properties superior to that of the partition alone.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A mounting assembly for mounting a device in a partition comprising:

a first bracket assembly including, a first bracket plate adapted to be mounted against an interior surface of the partition;

a first sliding bracket coupled to said first bracket plate and adapted to be coupled to a first member supporting the partition; and a second sliding bracket coupled to said first bracket plate and adapted to be coupled to a second member supporting the partition; and a second bracket assembly including, a second bracket plate adapted to be mounted against the interior surface of the partition;

a third sliding bracket coupled to said second bracket plate and adapted to be coupled to the first member supporting the partition; and a fourth sliding bracket coupled to said second bracket plate and adapted to be coupled to the second member supporting the partition.

2. The mounting assembly of claim 1, further comprising a fastener for coupling together said first bracket plate, said first sliding bracket, and said second sliding bracket.

3. The mounting assembly of claim 2, wherein said fastener comprises a threaded stud extending from said first bracket plate, said stud extending through a first slot in said first sliding bracket and a second slot in said second sliding bracket, and a nut adapted to be inserted onto said threaded stud for tightening.

4. The mounting assembly of claim 1, wherein said first sliding bracket and said second sliding bracket are adapted for sliding movement relative to each other and relative to said bracket plate.

5. The mounting assembly of claim 1, wherein said first bracket plate includes a lip for engaging a hole in the partition.

6. The mounting assembly of claim 1, further comprising a first fastener for coupling together said first bracket plate, said first sliding bracket, and said second sliding bracket of said first bracket assembly; and a second fastener for coupling together said second bracket plate, said third sliding bracket, and said fourth sliding bracket of said second bracket assembly.

7. The mounting assembly of claim 6, wherein said first fastener comprises a first threaded stud extending from said first bracket plate, said first threaded stud extending through a first slot in said first sliding bracket and a second slot in said second sliding bracket, and a first nut adapted to be inserted onto said first threaded stud for tightening, and wherein said second fastener comprises a second threaded stud extending from said second bracket plate, said second threaded stud extending through a third slot in said third sliding bracket and a fourth slot in said fourth sliding bracket, and a second nut adapted to be inserted onto said second threaded stud for tightening.

8. A mounting system comprising:

a first bracket assembly including, a first bracket plate adapted to be mounted against an interior surface of a partition;

a first sliding bracket coupled to said first bracket plate and adapted to be coupled to a first member supporting the partition; and a second sliding bracket coupled to said first bracket plate and adapted to be coupled to a second member supporting the partition;

a second bracket assembly including, a second bracket plate adapted to be mounted against the interior surface of the partition;

a third sliding bracket coupled to said second bracket plate and adapted to be coupled to the first member supporting the partition; and a fourth sliding bracket coupled to said second bracket plate and adapted to be coupled to the second member supporting the partition; and a loudspeaker including a lip and a clamp, wherein said loudspeaker is adapted to be inserted into a hole in the partition such that said first bracket assembly and the partition are sandwiched between said clamp and said lip.

9. The system of claim 8, wherein said loudspeaker includes a plurality of clamps, wherein said loudspeaker is adapted to be inserted in the hole the partition such that said first bracket assembly and the partition are sandwiched between at least one of said clamps and said lip and said second bracket assembly and the partition are sandwiched between at least one of said clamps and said lip.

10. The system of claim 8, wherein the partition is a ceiling.

11. The system of claim 8, wherein the partition is a wall.

12. The system of claim 8, further comprising:

a first fastener for coupling together said first bracket plate, said first sliding bracket, and said second sliding bracket; and a second fastener for coupling together said second bracket plate, said third sliding bracket, and said fourth sliding bracket.

13. The system of claim 12, wherein said first fastener comprises a first threaded stud extending from said first bracket plate, said first threaded stud extending through a first slot in said first sliding bracket and a second slot in said second sliding bracket, and a first nut adapted to be inserted onto said first threaded stud for tightening, and wherein said second fastener comprises a second threaded stud extending from said second bracket plate, said second threaded stud extending through a third slot in said third sliding bracket and a fourth slot in said fourth sliding bracket, and a second nut adapted to be inserted onto said second threaded stud for tightening.

14. The system of claim 8, wherein said first bracket plate includes a first lip for engaging the hole in the partition and said second bracket plate includes a second lip for engaging the hole in the partition.

15. A method of mounting a loudspeaker in a partition, comprising the steps of:

inserting a first bracket assembly into a hole in the partition, the first bracket assembly including a first bracket plate, a first sliding bracket coupled to the first bracket plate, and a second sliding bracket coupled to the first bracket plate;

coupling the first sliding bracket to a first member supporting the partition;

coupling the second sliding bracket to a second member supporting the partition;

inserting a second bracket assembly into the hole in the partition, the second bracket assembly including a second bracket plate, a third sliding bracket coupled to the second bracket plate, and a fourth sliding bracket coupled to the second bracket plate;

coupling the third sliding bracket to the first member;

coupling the fourth sliding bracket to the second member;

inserting the loudspeaker into the hole, wherein the loudspeaker includes a lip and a clamp;

clamping the bracket assembly and the partition between the clamp and the lip.

16. The method of claim 15, wherein the clamp comprises a plurality of mounting dogs, and wherein the step of clamping the bracket assembly comprises extending the mounting dogs from a position substantially parallel to an exterior surface of the loudspeaker to a position substantially perpendicular to the exterior surface, and moving the mounting dogs towards the lip to sandwich the bracket assembly and the partition between the mounting dogs and the lip.

17. The method of claim 15, wherein a diameter of the hole is smaller than a diameter of the loudspeaker at the lip.

18. The method of claim 15, wherein the first bracket plate and the second bracket plate are installed flush against an interior surface of the partition, and wherein the first bracket plate and the second bracket plate each include a lip for engaging the hole in the partition.

19. The method of claim 15, wherein the first bracket assembly further includes a first fastener for coupling together the first bracket plate, the first sliding bracket, and the second sliding bracket; and wherein the second bracket assembly further includes a second fastener for coupling together said second bracket plate, said third sliding bracket, and said fourth sliding bracket.

20. The method of claim 19, wherein the first fastener comprises a first threaded stud extending from the first bracket plate, the first threaded stud extending through a first slot in the first sliding bracket and a second slot in the second sliding bracket, and a first nut adapted to be inserted onto the first threaded stud for tightening, and wherein the second fastener comprises a second threaded stud extending from the second bracket plate, the second threaded stud extending through a third slot in the third sliding bracket and a fourth slot in the fourth sliding bracket, and a second nut adapted to be inserted onto the second threaded stud for tightening.

* * * * *